United States Patent [19]

Grüner et al.

[11] 4,121,923

[45] Oct. 24, 1978

[54] CRYSTALLINE STRUCTURE IN CONTINUOUSLY CAST STEEL INGOT

[75] Inventors: Hans Grüner; Hans Schrewe, both of Duisburg; Fritz Peter Pleschiutschnigg, Düsseldorf, all of Fed. Rep. of Germany

[73] Assignee: Mannesmann Aktiengesellschaft, Dusseldorf, Fed. Rep. of Germany

[21] Appl. No.: 823,945

[22] Filed: Aug. 12, 1977

[30] Foreign Application Priority Data

Aug. 11, 1976 [DE] Fed. Rep. of Germany ..... 2636400

[51] Int. Cl.[2] ..... C21C 7/00

[52] U.S. Cl. ..... 75/53; 75/58; 75/129

[58] Field of Search ..... 75/53, 129, 130; 164/75

[56] References Cited

U.S. PATENT DOCUMENTS

| | | | |
|---|---|---|---|
| 3,052,936 | 9/1962 | Hamilton | 75/53 |
| 3,795,505 | 3/1974 | Corradini | 75/53 |
| 3,980,479 | 9/1976 | Forster | 75/129 |

*Primary Examiner*—P. D. Rosenberg

*Attorney, Agent, or Firm*—Smyth, Pavitt, Siegemund, Jones & Martella

[57] ABSTRACT

The steel in a tundish is treated under pressure to add Ca, Mg or a rare earth for reducing dendritic and enhancing globulitic crystallation.

6 Claims, No Drawings

CRYSTALLINE STRUCTURE IN CONTINUOUSLY CAST STEEL INGOT

BACKGROUND OF THE INVENTION

The present invention relates to a method of improving the crystalline and grain structure and texture in continuously cast steel.

A machine for continuously casting of steel includes usually a tundish from which the molten steel is poured into the mold. As a consequence of the currently used method, a zone of dendritic crystal structure is formed in the solidifying casting; that is to say, the alloy elements such as Mn, S, C and others, have a higher concentration in the central portions of the casting than in more outwardly located zones. This change in concentration across the cross-section leads to liquation and separation of alloy elements in the center of the ingot.

DESCRIPTION OF THE INVENTION

It is an object of the present invention to improve the crystal structure of continously cast steel ingots by reducing the dendritic solidification and enhencing the globulitic solidification.

In accordance with the preferred embodiment of the present invention, it is suggested to modify the use of the tundish in that quick-vaporizing additives are added to the liquid steel under excess pressure such as two atmospheres so that the formation of seeds for globulitic solidification is enhenced. The additives should form oxides, and one will use Ca, Mg or rare earth materials, all preferably in powder form, and with an evaporation temperature of 1500° C. or below. It was found that the elements solved in the steel are better distributed in the ingot if the steel is treated in the tundish in the stated manner. A more uniform distribution of the alloy additives improves the steel, particulary in regard to further working and processing the ingot.

In practicing the invention, one may use a pressure chamber surrounding the steel as pouring into the tundish to which is added Ca, Mg or a rare earth. In addition, unalloyed or alloyed iron powder may be added to the steel to further enhence seed formation for globulitic crystallization. Equipment usuable in conjunction with this process is shown in application Ser. No. 770,449, filed Feb. 18, 1977, by us and others.

We found that by adding at least 360 g per minute Ca and/or Mg to the steel at a casting rate and steel through-put of 6 tons (metric) per minute, the final oxygen content was 30 ppm. More than doubly the Ca/Mg amount per minute and for the same steel through-put of 6 tons per minute resulted in the same oxygen content and 60 ppm sulfur in final steel.

The invention is not limited to the embodiments described above but all changes and modifications thereof not constituting departures from the spirit and scope of the invention are intended to be included.

We claim:

1. Method of improving the crystallization and grain structure and texture in continuously cast steel ingots to enhance globulitic solidification therein and wherein the steel is poured from a tundish into at least one mold, comprising the step of treating the steel in the tundish under pressure, at about 2 atmospheres, with fast-evaporating, oxide forming additives, vaporizing at a temperature of 1500° C. or below, so that the resulting seeds enhance globulitic solidification.

2. In a method as in claim 1, using Mg as additive.

3. In a method as in claim 1, using a rare earth as additive.

4. In a method as in claim 1, wherein the additives are added in powder form.

5. In a method as in claim 1, using Ca as additive.

6. In a method as in claim 5, and including the step of adding iron powder as seeds to the steel in the tundish.

* * * * *

UNITED STATES PATENT AND TRADEMARK OFFICE

CERTIFICATE OF CORRECTION

PATENT NO. : 4,121,923

DATED : October 24, 1978

INVENTOR(S) : HANS GRUNER, HANS SCHREWE and FRITZ-PETER PLESCHIUTSCHNIGG

It is certified that error appears in the above-identified patent and that said Letters Patent are hereby corrected as shown below:

[19] GRUNER et al

[75] HANS GRUNER; HANS SCHREWE, both of Duisburg; and FRITZ-PETER PLESCHIUTSCHNIGG, Düsseldorf; all of the Fed. Rep. of Germany Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*